US008950367B2

(12) United States Patent
Jensen et al.

(10) Patent No.: US 8,950,367 B2
(45) Date of Patent: Feb. 10, 2015

(54) COOLING FAN SHROUD

(75) Inventors: Jeff A. Jensen, Dunlap, IL (US); Alexander Speros Leanos, Metamora, IL (US); Donald Lemont Stamets, Bloomington, IL (US); Gerald Alan Nuese, Peoria, IL (US); John Curtis Simkins, Tremont, IL (US); Casey Bradford Behringer, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/561,227

(22) Filed: Jul. 30, 2012

(65) Prior Publication Data

US 2014/0026833 A1 Jan. 30, 2014

(51) Int. Cl.
*F01P 7/10* (2006.01)

(52) U.S. Cl.
USPC ..... 123/41.49

(58) Field of Classification Search
USPC ..... 123/41.49
See application file for complete search history.

(56) References Cited

U.S. PATENT DOCUMENTS

| | | | | |
|---|---|---|---|---|
| 2,584,933 | A * | 2/1952 | Spear | 454/354 |
| 3,776,122 | A * | 12/1973 | Julian | 454/228 |
| 3,980,132 | A | 9/1976 | Mitchell et al. | |
| 5,623,893 | A | 4/1997 | Bartz et al. | |
| 5,664,536 | A * | 9/1997 | Bigsby | 123/193.4 |
| 6,082,969 | A | 7/2000 | Carroll et al. | |
| 6,450,760 | B1 * | 9/2002 | Furukawa et al. | 415/119 |
| 6,454,527 | B2 * | 9/2002 | Nishiyama et al. | 415/119 |
| 6,543,523 | B2 * | 4/2003 | Hasumi | 165/125 |
| 2007/0157592 | A1 * | 7/2007 | Merant et al. | 56/328.1 |
| 2007/0187075 | A1 | 8/2007 | Yamada et al. | |
| 2009/0047122 | A1 * | 2/2009 | Medynski et al. | 415/173.1 |

FOREIGN PATENT DOCUMENTS

EP 0 531 025 A1 8/1992

* cited by examiner

*Primary Examiner* — Lindsay Low
*Assistant Examiner* — Charles Brauch
(74) *Attorney, Agent, or Firm* — Miller, Matthias & Hull LLP

(57) ABSTRACT

A cooling fan shroud comprises multiple, functionally identical sections that form a ring-like structure that completely surrounds the fan when the shroud is installed onto an aperture plate or other structure. The shroud makes the cooling system more efficient by improving air flow at a given fan speed by reducing fan tip clearance, and increasing air flow due through the fan. An alternative, single piece shroud is also provided which can be retrofitted to an existing cooling system.

10 Claims, 9 Drawing Sheets

COOLING FAN SHROUD

TECHNICAL FIELD

This disclosure relates generally to a cooling fan shroud for heavy duty vehicles. More particularly, this disclosure relates to a cooling fan shroud for heavy duty vehicles that helps direct air flow through the cooling fan, thereby reducing power requirements, sound emissions and fuel consumption.

BACKGROUND

Heavy duty construction machines such as loaders, tractors, bulldozers, excavators, ground movers and the like generally comprise a machine frame, a work implement mounted to the machine frame and an internal combustion engine to power the work implement. A cooling system may be provided for cooling the engine, the cooling system typically comprising a radiator and a fan enclosed within a housing or cover. The fan may be driven hydraulically, electronically or mechanically via a belt system.

The radiator may be mounted on the machine frame next to the engine. In some machines the cooling fan is located outboard the radiator. The fan pulls cooling air through the radiator for engine cooling purposes, and the air is discharged through the fan grill.

In other machines the fan is located between the radiator and the engine. The fan pushes cooling air through the radiator for engine cooling purposes, and the air is discharged through air exhaust ports typically formed in the cooling system housing.

The fan may be rotatively driven by a hydraulic pump working off the engine, or the fan may be belt driven using a fan belt that works off the engine.

Some cooling fans are located within a circular opening in an aperture plate. Aperture plates are low cost, but they have significant disadvantages in terms of sound emissions, power requirements and fuel consumption. For example, aperture plates have a knife edge that can disrupt the flow of air through the fan.

The present disclosure is directed toward one or more of the problems set forth above.

SUMMARY OF THE DISCLOSURE

In one aspect of the disclosure, a shroud is provided that can be installed around the fan to channel air to and away from the fan. The shroud is mountable to an aperture plate having a circular knife edge defining a circular opening. The shroud comprises two or more functionally identical sections that fit together to form the shroud. Each section comprises an annular body having a convex inner surface and a concave outer surface, a bell shaped downstream section and a bell shaped upstream section extending from either end of a cylindrical duct. The downstream section terminates in a substantially circular downstream end. The upstream section terminates in a substantially circular upstream end. A mounting flange is affixed to the outer surface of each section at the duct and extends radially outward therefrom.

In another aspect, a method of installing a multiple piece shroud in a cooling system is provided. The multiple piece shroud comprises multiple sections, each section comprising a mounting flange. The cooling system comprises a radiator, a housing, an aperture plate mounted to the housing and having a circular knife edge defining a circular opening, a hydraulically driven cooling fan located outboard (away from the engine) of the radiator and mounted to a bracket. The bracket has a top connected to the housing by fasteners. Hydraulic hoses may be operably connected to the fan. A grill may be located outboard the fan and bracket. As part of the method, the grill is removed. The hydraulic hoses, if any, are disconnected from the fan. The fasteners that hold the top of the bracket to the housing or other structure are removed so that the fan and the bracket may be rotated (leaned) outward, away from the radiator, to create workspace. Next, the shroud sections are installed one section at a time. Each shroud section is affixed to the aperture plate with fasteners.

Similarly, in still another aspect of the invention, a method of replacing one or more damaged sections of a multiple piece shroud mounted in a cooling system is provided. The method comprises removing the grill and disconnecting any hydraulic hoses from the fan (if the fan is hydraulically driven). The fasteners that hold the top of the fan bracket to the housing are removed so that the fan and bracket can be leaned outward away from the radiator 16 to create workspace. The damaged sections can then be removed. Finally, the new shroud sections are installed by affixing each of the one or more new sections to the aperture plate 18 with fasteners.

In yet another aspect of the disclosure the shroud is a single unitary structure. The single piece shroud is mountable to a mounting structure to reduce fan tip clearance between the mounting structure and a fan. The mounting structure has a circular knife edge defining a circular opening or aperture having an aperture radius. The fan blade tips define a fan tip radius. The shroud comprises an annular, outwardly curved body having a convex, fan-facing surface and a concave outer surface. The fan further comprises a cylindrical duct having two ends and defining a shroud inner radius, a bell shaped downstream section extending from one end of the duct and terminating in a circular downstream end defining a shroud downstream end radius, and a bell shaped upstream section extending from the other end of the duct and terminating in a circular upstream end defining a shroud upstream end radius. The shroud also comprises a mounting flange affixed to the concave surface of the body and extending radially outward therefrom. The mounting flange has an outer perimeter defining a flange outer perimeter radius. In a key aspect of the disclosure there is diametrical clearance between the body upstream end and the knife edge 32 so that at least one side of the shroud can fit within the aperture plate.

Finally, is still another aspect of the invention, a method of installing a single piece cooling fan shroud on an aperture plate is provided, in which the aperture plate has a knife edge and defines a plurality of spaced apart circumferentially disposed first openings for receiving fasteners. The method comprises the steps of: providing a cooling fan shroud comprising an annular, outwardly curved body having a downstream end, a duct and an upstream end and a flange affixed to the duct and extending radially outward therefrom, the flange having a distal end and a proximal end adjoining the body, the flange defining a plurality of spaced apart circumferentially disposed flange openings for receiving fasteners alignable with the aperture plate openings; positioning the shroud so that the flange openings align with the aperture plate openings; and securing the shroud to the aperture plate with fasteners.

DETAILED DESCRIPTION

Figure 1:
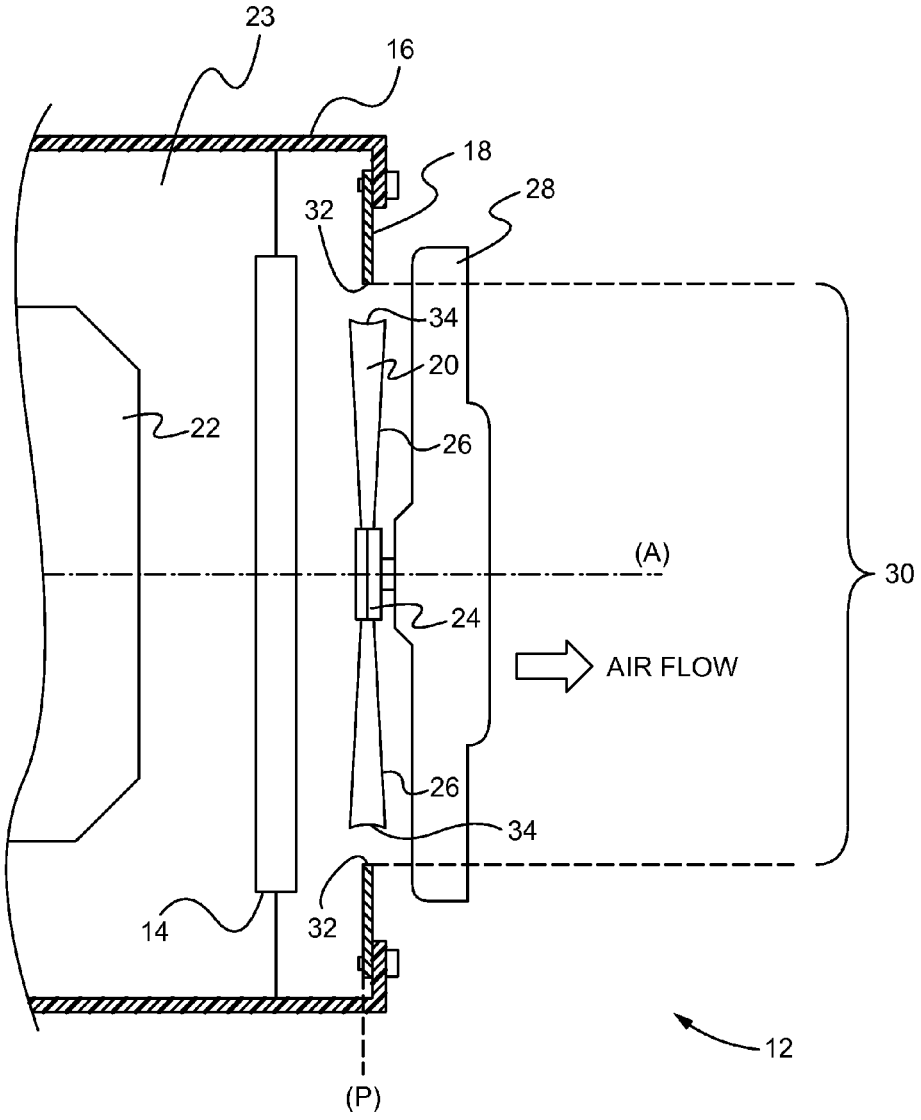
FIG. 1 is a side cross-sectional view of an engine cooling system in which the cooling fan is located on the side of the radiator away from the engine.

While this disclosure may be embodied in many forms, there is shown in the drawings and will herein be described in detail one or more embodiments with the understanding that this disclosure is to be considered an exemplification of the principles of the disclosure and is not intended to limit the disclosure to the illustrated embodiments.

Turning to the drawings, there is shown in FIG. 1 an engine cooling system indicated generally at 12 and comprising a radiator 14, a housing 16, an aperture plate 18 and a cooling fan 20. The radiator 14 may be mounted to a machine frame (not shown) or to the housing 16 at a location adjacent the cooling fan 20 and may be oriented normal to the axis of rotation (A) of the fan 20. The housing 16 may serve as a structural support for the aperture plate 18 and may be mounted to the machine frame.

In some cooling systems 12 like the one shown in FIG. 1, the fan 20 is located outboard (downstream) of the radiator 14 on the side away from the engine 22 and pulls air from the engine compartment 23 through the radiator 14 to facilitate the transfer of heat from the coolant circulating within the radiator 14 to the ambient air. This engine-radiator-fan arrangement is common in bulldozers.

Figure 8:
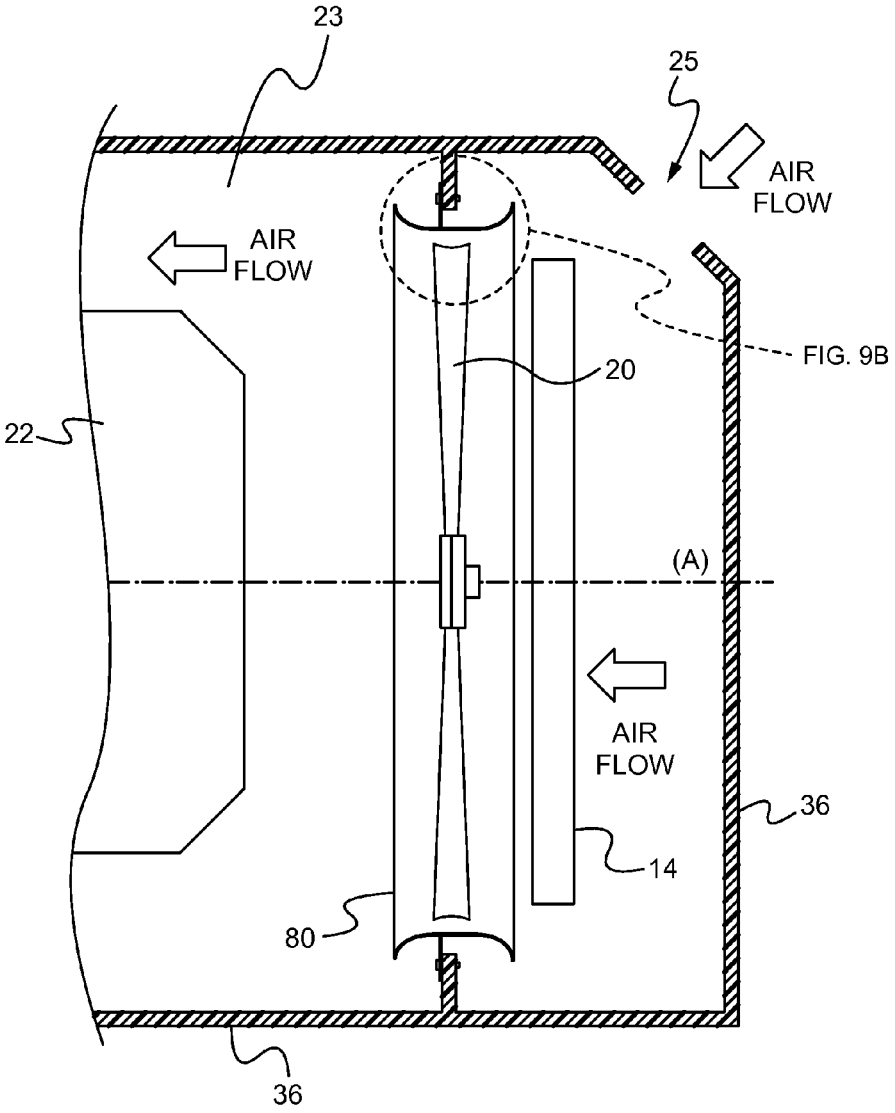
FIG. 8 is a side cross-sectional view of another engine cooling system, one in which the cooling fan is located on the side of the radiator facing the engine, and including a one piece shroud.

In other cooling systems like the one shown in FIG. 8, the fan 20 is located downstream of the radiator, between the radiator 14 and the engine 22. The fan 20 pulls air from the outside through air intake openings 25 in the housing 36 and through the radiator 14, after which the air exits the engine compartment 23 through air exhaust openings (not shown).

The fan 20 generally comprises a hub 24 and a plurality of spaced apart blades 26 connected to and radiating outwardly from the hub 24. The hub 24 is mounted to a bracket 28 or other structure. The bracket 28 or other structure may be mounted to the cooling system housing 16, the aperture plate 18, the machine frame or any other suitable structure by fastening means. For example, the bracket 28 may be mounted on hinges (not shown) located at the bottom of the bracket 28 and secured to the cooling system housing 16 by fasteners (not shown) located at the top of the bracket 28 so that, by removing the fasteners, the fan 20 and bracket 28 can be tilted outward for easier access to the radiator 14 and the aperture plate 18.

The aperture plate 18 is substantially planar and may define a plane (P) normal to the fan axis (A). The aperture plate 18 may have a circular, inwardly facing perimeter edge 32, also known as a "knife edge", which defines a large circular central opening 30. The fan 20 may be horizontally aligned with the central opening 30 and may be aligned with or offset from the plane (P). The size of the central opening 30 is generally a function of the size of the fan 20 and generally will have a diameter slightly larger than that of the fan 20. The distance between the tips (distal edges) 34 of the fan blades 26 and the knife edge 32 is referred to as the fan tip clearance.

For safety, an optional protective grill (not shown) constructed of spaced wire formed into a domed or other configuration may be positioned outboard the fan 20 and bracket 28.

Cooling fans that are hydraulically powered work off of a hydraulic pump powered by the engine. Cooling fans that are belt driven work off of a fan belt that is rotated by an engine drive pulley connected to the crankshaft powered by the engine. Either way, cooling fans are a parasitic load on the engine, and the power drain from the cooling fan can be as much as twenty kilowatts (kW) or more. Increasing air flow by increasing fan speed requires an exponential increase in power drain from the engine and thus fuel consumption, as well as increased noise. Increasing fan speed can also result in increased fan tip erosion. Adding a shroud, as described below, can improve air flow without increasing fan speed, which results in better cooling at lower engine loads and also less fan noise.

Figure 2:
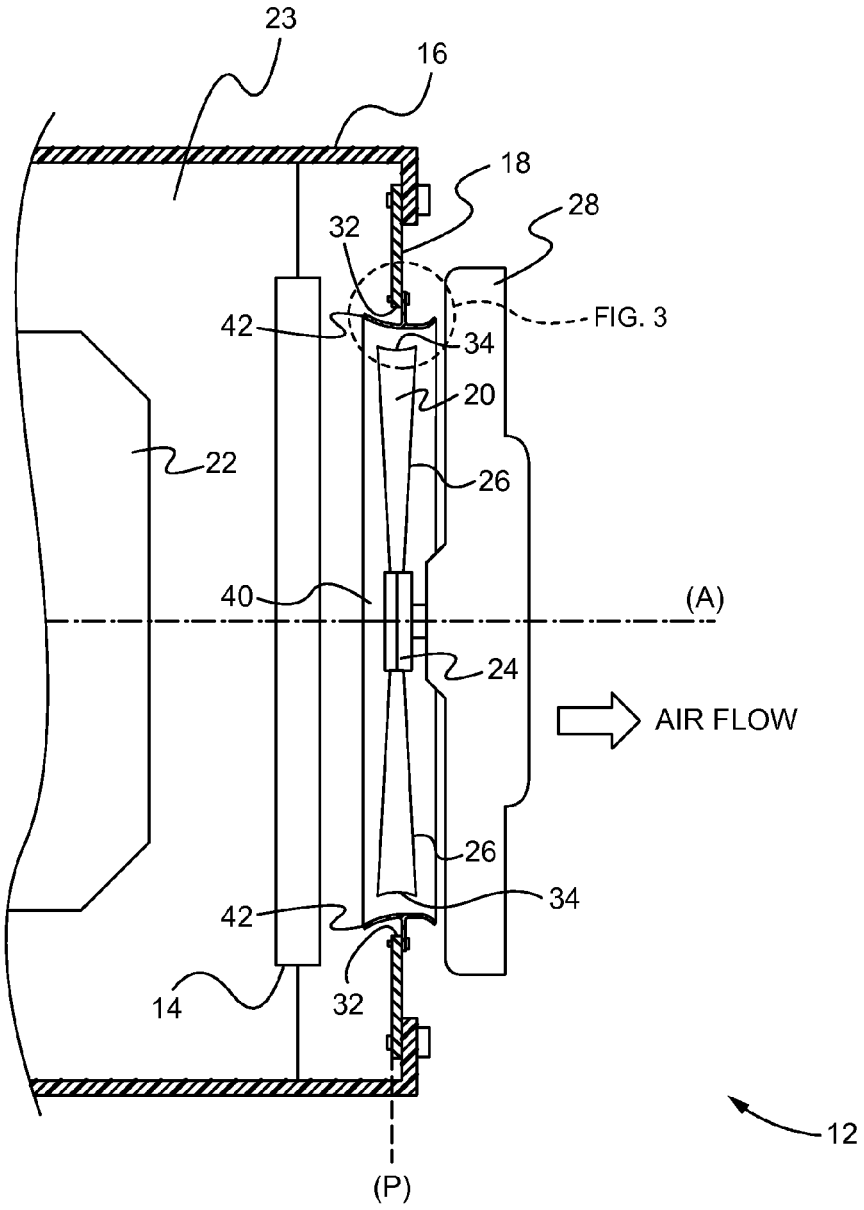
FIG. 2 is a side cross-sectional view of the engine cooling system of FIG. 1 shown with a fully assembled and installed shroud according to the present disclosure.
Figure 3:
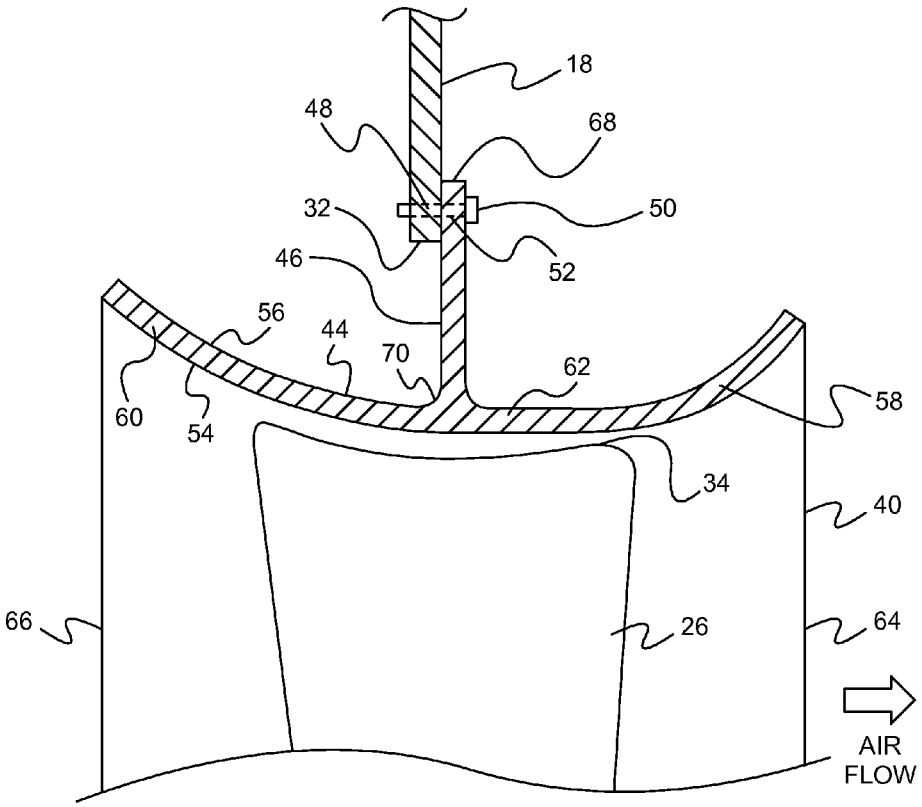
FIG. 3 is a partial close up view of the shroud, fan and aperture plate of FIG. 2.

FIG. 2 is a side cross-sectional view of the engine cooling system of FIG. 1 with the addition of a cooling fan shroud 40 according to the present disclosure. FIG. 3 is a partial close up view of FIG. 2 showing the shroud 40 in greater detail. According to one embodiment of the present disclosure, the shroud 40 comprises multiple, functionally identical sections 42 that form a ring-like structure 40 that completely surrounds the fan 20 when the shroud 40 is installed onto the aperture plate 18.

In order to mount the sections 42 of the shroud 40 to the aperture plate 18, the aperture plate 18 has spaced apart, circumferentially disposed openings 48 for receiving bolts or other fasteners 50. Each shroud section 42 has flange openings 52 spaced apart at the same intervals as the aperture plate openings 48 so that, when each shroud section 42 is positioned with its flange 46 abutting the aperture plate 18, the shroud flange openings 52 and the aperture plate openings 48 align to receive the fasteners 50. There may be some play (extra space) designed into the aperture plate openings 48 and/or in the flange openings 52 relative to the opening in the other structure to help position the shroud sections 42 on the aperture plate 18 for proper fan tip clearance. If necessary, fastener openings may be drilled through the flange 46 and/or aperture plate 18 for mounting purposes.

The shroud 40 may comprise two, three, four, five or any suitable number of identical sections 42, with four being the preferred number because each section 42 presents a right angle for easy installation. Because the sections are identical, only one part needs to be manufactured, resulting in cost-efficiencies.

Figure 4:
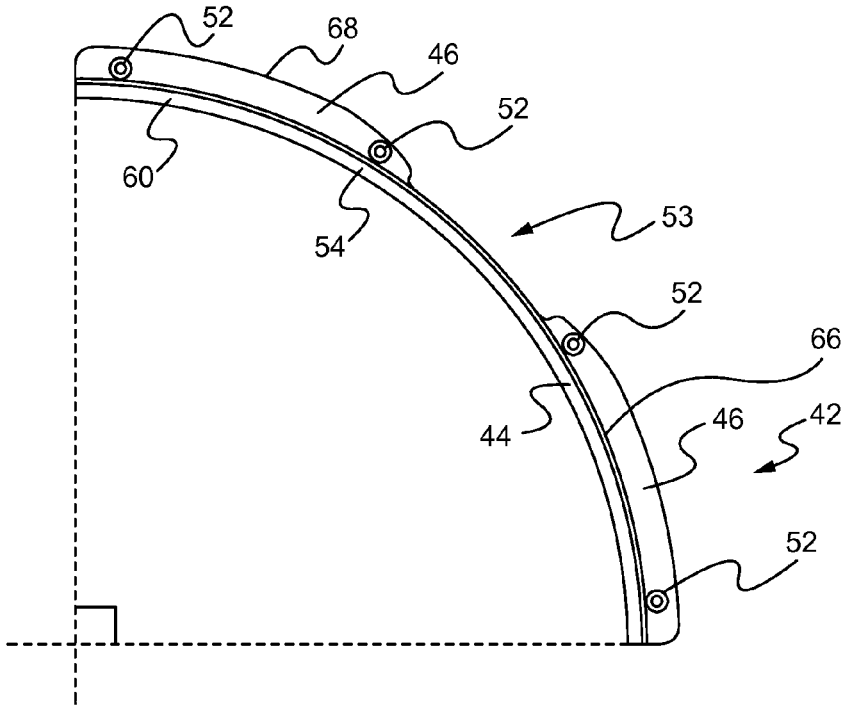
FIG. 4 is a front view of one of the shroud sections.
Figure 5:
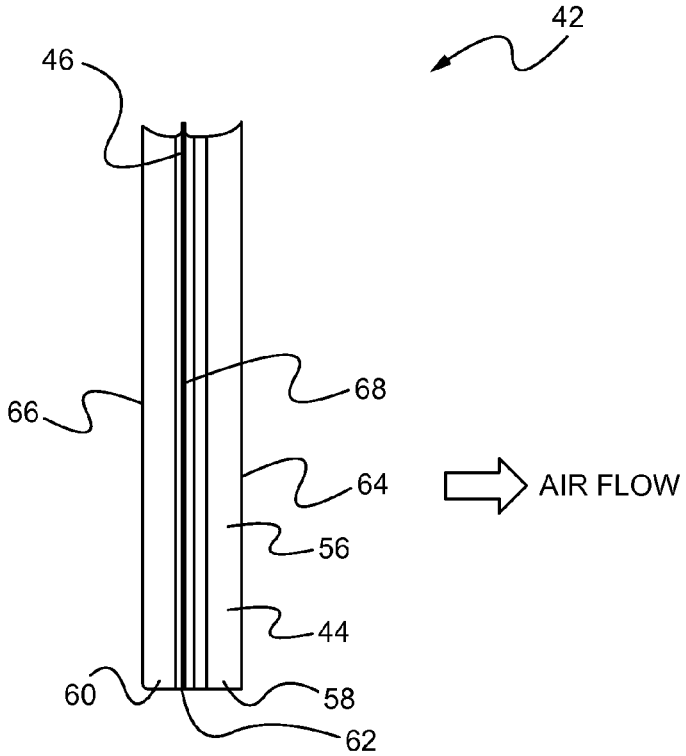
FIG. 5 is a right side view of the shroud section of FIG. 4.
Figure 6:
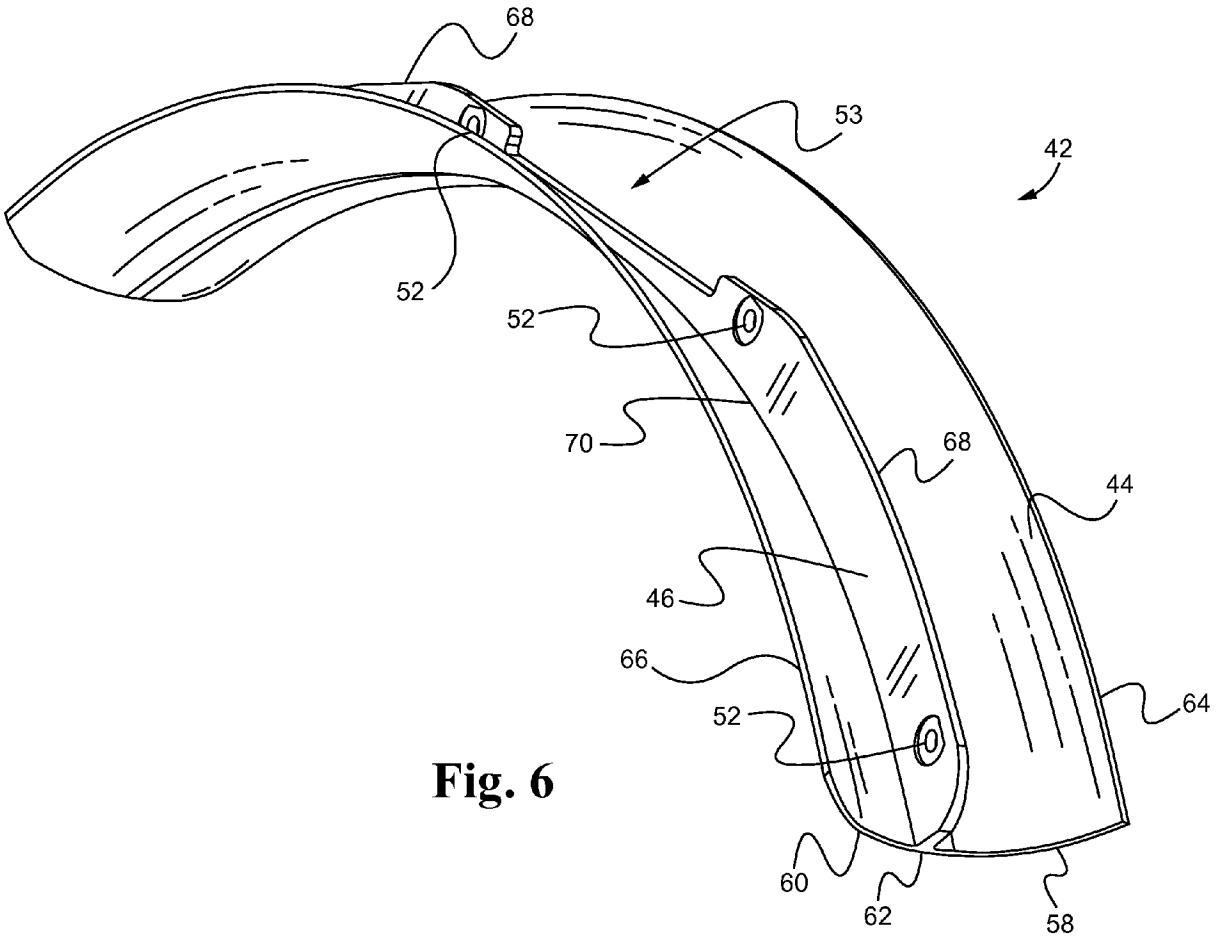
FIG. 6 is a perspective view of the shroud section of FIG. 4.

FIGS. 4, 5 and 6 are various views of a section 42 of a four piece shroud 40. Because the shroud 40 is substantially circular, each section 42 describes a ninety degree arc. (In a three section shroud each section describes a one hundred and twenty degree arc; in a two section shroud each section describes a one hundred and eighty degree arc; etc.) Each section 42 comprises an annular body 44 and a substantially planar mounting flange 46 connected to the body 44 and extending outward therefrom.

As best shown in FIG. 3, the annular body 44 has a generally C-shaped radial cross-sectional profile, with an optional cylindrical duct 62 that appears relatively flat in the cross-sectional view of FIG. 3. The body 44 is generally outwardly curved (curved away from the fan 20) on either side of the duct 62, giving the body 44 a substantially convex, inner (fan-facing) surface 54 and a substantially concave outer (aperture plate-facing) surface 56. The annular body 44 further comprises a bell shaped downstream section 58 and a bell shaped upstream section 60 extending from either side of the duct 62. The downstream section 58 terminates in a substantially circular downstream end 64 and the upstream section 60 terminates in a substantially circular upstream end 66.

The mounting flange 46 is affixed to the outer surface 56 of the duct 62 and extends radially outward therefrom, forming an annular, ring-like structure. The mounting flange 46 has an outer edge or perimeter 68 and an inner end or perimeter 70 that adjoins the annular body 44, preferably along the duct 62.

As noted above, the flange 46 has axially oriented openings 52 spaced apart at the same intervals as the aperture plate openings 48, either as original equipment features or drilled in later. The flange 46 may be discontinuous, that is, the flange 46 may have discontinuities or gaps 53 (FIG. 4) that make it easier to bend or otherwise distort the section 42 if needed for installation.

The shroud 40 may be made of metal, plastic, composite material such as fiberglass, or any suitable material. The multiple sections 42 are partially nestable so the shroud 40 can be shipped in a smaller space than a single piece shroud.

The amount and quality of airflow through the fan 20 is a function of, among other things, fan speed, fan projection (i.e., location of the fan 20 with respect to the shroud 40), and the shape of the shroud 40. Therefore the upstream section 60 of the shroud 40 may be optimized to guide or channel the flow of air into the fan 40, while the downstream section 58 of the shroud 40 may be designed to maximize air flow by transitioning the exiting air from axial to radial flow.

Although the multiple piece cooling fan shroud 40 is shown in FIG. 2 as part of a cooling system 12 in which the fan 20 is located outboard of the radiator 14, it should be understood that the shroud 40 also may be used as part of a cooling system in which the fan 20 is located between the radiator 14 and the engine 22 like that shown in FIG. 8.

The shroud 40 can be installed as original equipment. The shroud 40 can also be added to a cooling system 12 like that shown in FIG. 1 as part of a retrofitting. Finally, damaged sections 42 of a multiple-piece shroud 40 can be replaced in the field.

The installation of a new shroud 40 as part of a cooling system retrofitting will now be described with respect to the cooling system 12 of FIG. 1. As previously noted, the cooling system 12 comprises a radiator 14, a housing 16, an aperture plate 18, a cooling fan 20, a bracket 28 and a grill (not shown). The bracket 28 has a top connected to the housing 16 by fasteners (not shown). The housing 16 serves as a structural support for the aperture plate 18. The fan 20 is located outboard (downstream) of the radiator 14 and is mounted to the bracket 28. The aperture plate 18 has a circular knife edge 32 defining a circular opening 30.

The shroud 40 may be installed from the front (downstream) side of such a cooling system 12 by removing the protective grill (not shown in FIG. 1), unhooking some of the hydraulic hoses if the fan is hydraulically driven (also not shown in FIG. 1), undoing some of the bolts that hold the bracket 28 in place (not shown), leaning the fan 20 and bracket 28 outward to create workspace, and installing the shroud sections 42, one section 42 at a time. The shroud sections 42 are affixed to the aperture plate 18 and may also be affixed to each other. If the fastener openings in the shroud sections 42 and the aperture plate 18 do not align, it may be necessary to drill new openings in one or the other to accommodate the fasteners 50.

If one or more shroud sections 42 become broken or damaged, the sections 42 also can be replaced from the front (downstream) side of the cooling system 12 (outboard the fan 20) in a similar manner. That is, by removing the protective grill, unhooking some of the hydraulic hoses, undoing some of the bolts that hold the bracket 28 in place, leaning the fan 20 and bracket 28 outward to create workspace, removing the damaged section(s) 42 and installing new section(s) 42.

Figure 7:
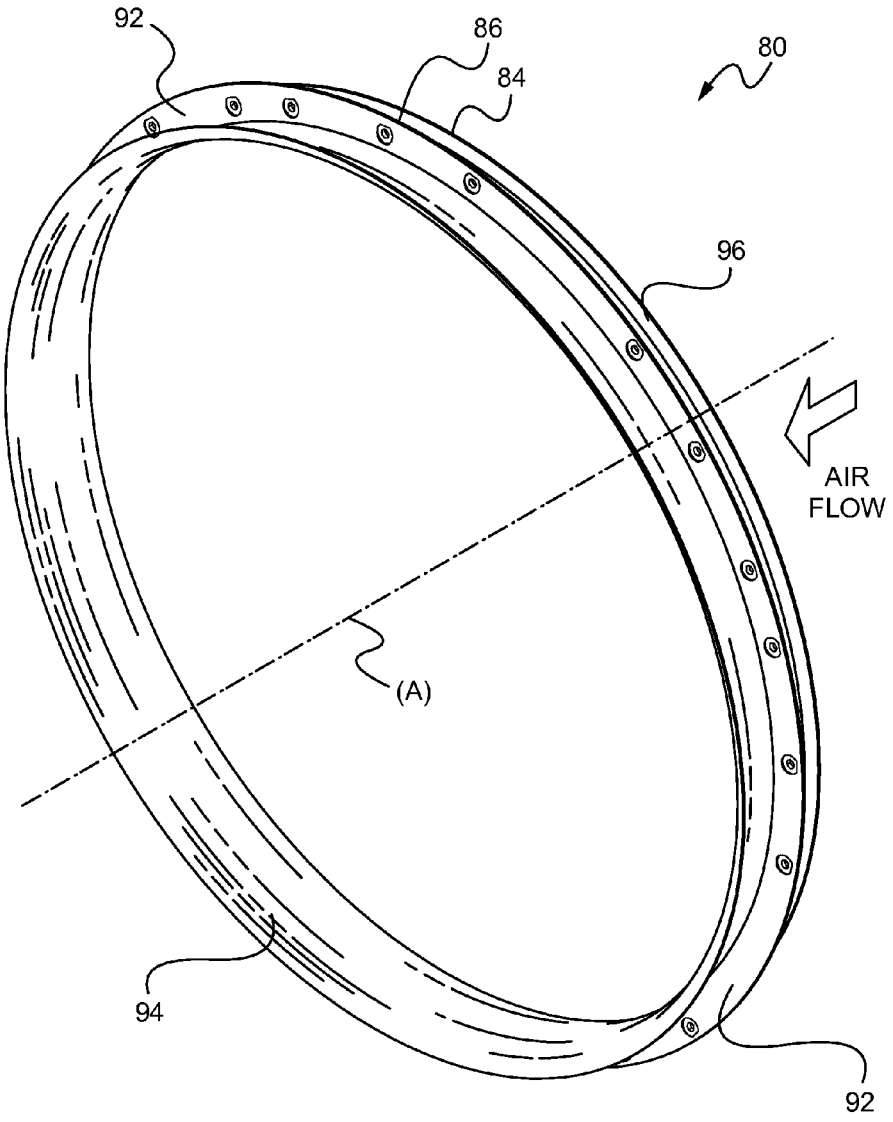
FIG. 7 is a perspective view of a first alternative embodiment of a shroud in which the shroud is a single piece.

FIGS. 7-9 show another aspect of the disclosure, a single piece shroud 80. Like the multiple piece shroud 40, the single piece shroud 80 is substantially circular and comprises an annular body 84 and a substantially planar mounting flange 86 connected to the body 84. In contrast to the multiple piece shroud 40, the single piece shroud 80 may be formed of roll bent aluminum with two ends that are connected to form a single, circular structure. Manufacturing single piece, extruded aluminum shrouds of varying diameters can be accomplished using a single extrusion die by extruding aluminum pieces of different lengths. After extrusion, the aluminum piece is simply bent to the desired diameter.

The single piece shroud 80 may be installed as original equipment. In some cases, despite being a single piece, the shroud 80 also may be installed in the field without removing the fan 20 and without bending or otherwise distorting the shroud 16 due to its unique geometry, as explained below.

Like the multiple piece shroud 40, the single piece shroud 80 may be used in any suitable cooling system, including the cooling system shown in FIG. 1 in which the cooling fan 20 is located on the side of the radiator 14 away from the engine 22, as well as the cooling system shown in FIG. 8 in which the fan 20 is located between the radiator 14 and the engine 22. In the latter case, the shroud 80 may still be installed in the field without too much difficulty, as explained below.

Figure 9A:
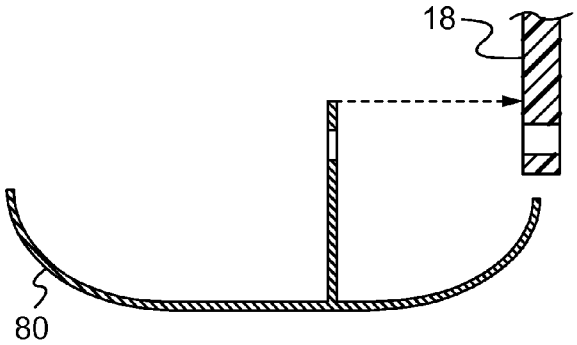
FIG. 9 is a partial close up view of the shroud, fan and aperture plate of FIG. 8.
Figure 9B:
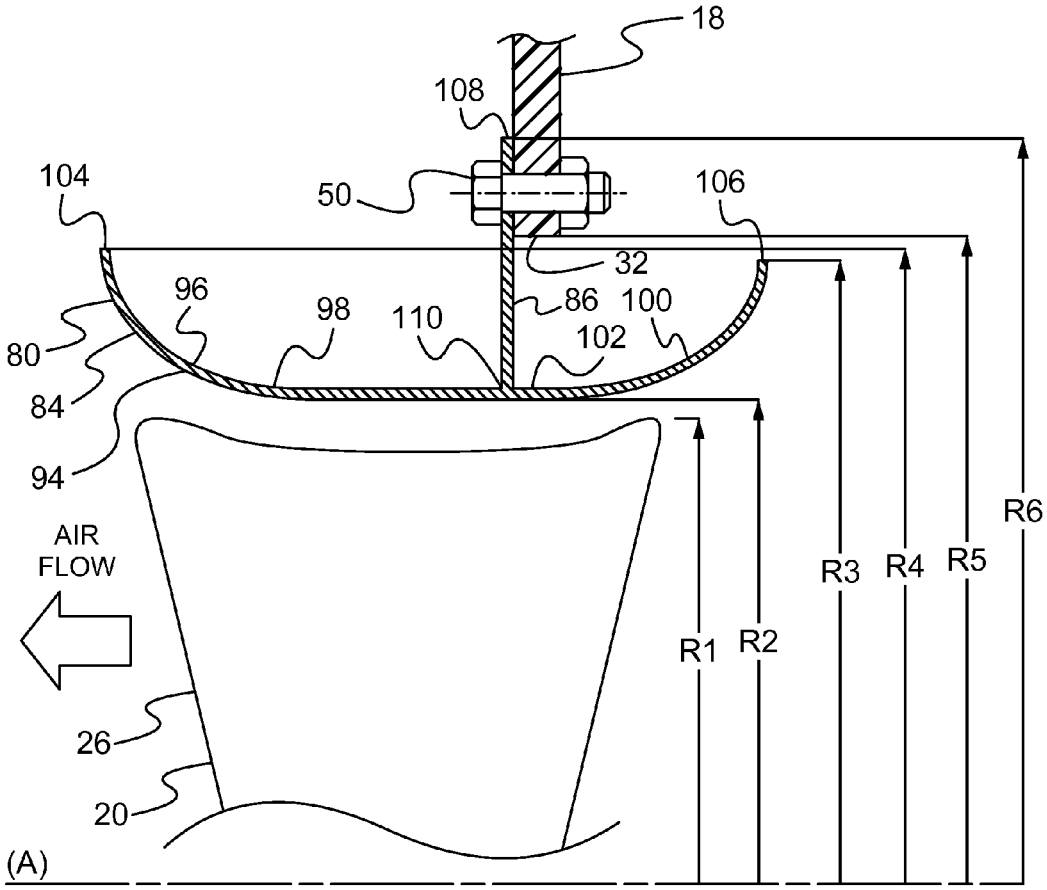

As best shown in FIGS. 9A and 9B, the annular body 84 has a generally C-shaped axial cross-sectional profile. The body 84 is outwardly curved (curved away from the fan 20) and has a substantially convex, inner (fan-facing) surface 94 and a substantially concave outer surface 96. The annular body 84 further comprises a bell shaped downstream section 98 and a bell shaped upstream section 100 extending from either end of an optional, cylindrical duct 102. The downstream section 98 terminates in a substantially circular downstream end 104 and the upstream section 100 terminates in a substantially circular upstream end 106.

As in the previous, multiple piece, embodiment, the mounting flange 86 may be affixed to and extend radially outward from the outer surface 96 of the duct 102. The mounting flange 86 has an outer edge or perimeter 108 and an inner end or perimeter 110 adjoining the annular body 84. The shroud 80 and, more particularly, the flange 86, are affixed to the aperture plate 18 by fasteners 50 such as bolts. Both the flange 86 and aperture plate 18 have openings that align when the shroud 80 is installed for receiving fasteners 50 there through. The openings may be formed as original equipment features in the shroud 80 and/or aperture plate 18 or drilled later on as needed.

In the discussion that follows various terms are used that will now be defined:

- Fan tip radius (R1): the distance of the fan blade tips 34 from the fan axis (A).
- Shroud inner radius (R2): the radial distance defined by the shroud duct 102; also, the inner radius of the shroud. If the shroud 80 is positioned concentrically around the fan 20 as shown in FIG. 9B, then R2 is the distance from the shroud duct 102 to the fan axis (A).
- Shroud upstream end radius (R3): the radial distance defined by the shroud upstream end 106. If the shroud 80 is positioned concentrically around the fan 20 as shown in FIG. 9B, then R3 is the distance from the shroud upstream end 106 to the fan axis (A).

Shroud downstream end radius (R4): the radial distance defined by the shroud downstream end 106. If the shroud 80 is positioned concentrically around the fan 20 as shown in FIG. 9B, then R4 is the distance from the shroud downstream end 104 to the fan axis (A).

Aperture radius (R5): the radial distance defined by the opening 30 in the aperture plate 18. If the fan 20 is positioned concentrically with respect to the aperture plate 18 as shown in FIG. 9B, then R5 is the distance from the aperture plate knife edge 32 to the fan axis (A).

Flange outer perimeter radius (R6): the radial distance defined by the flange outer perimeter 108. If the shroud 80 is positioned concentrically around the fan 20 as shown in FIG. 9B, then R6 is the distance from the flange outer perimeter 108 to the fan axis (A).

Figure 10:
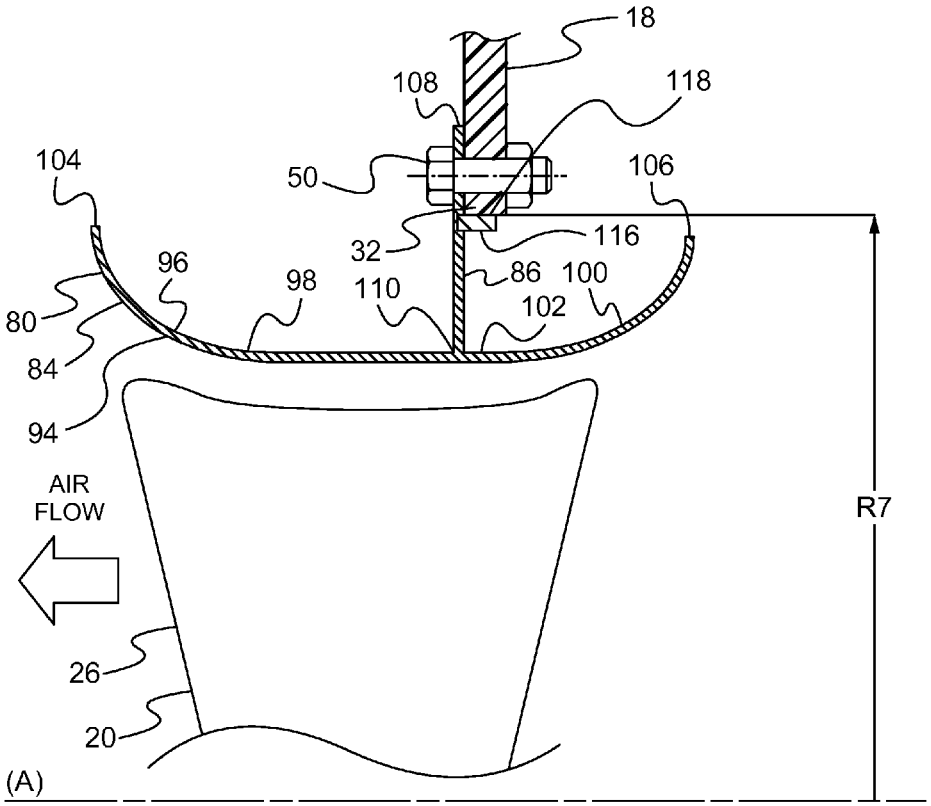
FIG. 10 is a close up cross sectional view of a self-locating shroud, shown installed on an aperture plate.

Self-locating ring outer radius (R7): the radial distance defined by the outer surface of the self-locating ring 116. If the shroud 80 is positioned concentrically around the fan 20 as shown in FIG. 10, then R7 is the distance from outer surface of the self-locating ring 116 to the fan axis (A).

In cooling systems like that shown in FIGS. 8 and 9 in which the aperture plate 18 and fan 20 are located between the engine and the radiator, and thus the radiator 14 is upstream of the fan 20, installing the shroud 80 from the engine (downstream) side 112 of the aperture plate 18 has advantages over installing the shroud 80 from the radiator (upstream) side 114. Installing the shroud 80 from the radiator side can require pulling out the radiator 14, which takes a significant amount of time. Installing the shroud 80 from the engine side typically requires removing only a couple of hoses and the fan bracket.

Despite being a single piece, the shroud 80 may be installed onto an aperture plate 18 from the engine side without removing the fan 20 and without significant bending or other distorting of the shroud 80. This can be accomplished if there is sufficient clearance between the fan 20 and the aperture plate 18. That is, the single piece shroud 80 may be installed without removing the fan 20 if at least one side of the shroud 80 fits between the fan 20 and the aperture plate 18 (or other structure within which the fan 20 is located, i.e., transversely aligned). Put another way, the tip clearance between the fan blades 26 and the aperture plate 18 must be sufficiently large to allow the shroud 80 to be inserted between the fan 20 and the aperture plate 18.

For example, and referring to FIGS. 9A and 9B, the single piece shroud 80 may be installed onto the engine side of the aperture plate 18 without removing the fan 20 if the shroud upstream end 100 fits between the fan 20 and the aperture plate 18. More particularly, the shroud inner radius R2 must be greater than the fan tip radius R1 so that the shroud clears the fan blades 26, and the shroud upstream end radius R3 must be less than the aperture radius R4 so that the shroud 80 fits within the aperture plate 18.

At the same time, the shroud flange 86 must extend radially outward far enough so that the flange 86 can be affixed to the aperture plate 18 or other mounting structure. This requires that the flange outer perimeter radius R6 be sufficiently larger than the aperture radius R5 to enable the flange 86 to be mounted to the aperture plate 18 with fastening means 50.

In a retrofitting situation where the shroud 80 is being installed in the field, the diameter of the fan 20 may be too big to allow the installation of a shroud. (The tip clearance may be too small.) If this is the case, then the old fan can be replaced with a smaller diameter fan to allow room for the shroud 80. If necessary, openings can be drilled into the aperture plate 18 and/or shroud 80 to accommodate the fasteners 50 that secure the shroud 80 to the aperture plate 18.

FIG. 10 illustrates a further embodiment of the disclosure in which the shroud 80 further comprises an annular self-locating ring 116 extending axially from at least one side of the flange 86. Preferably the self-locating ring 116 is circular, extends axially from the radiator (upstream) side of the flange 86, and has an outer surface 118 that defines a self-locating ring outer radius R7 substantially equal to or slightly less than the aperture radius R5. In other words, the locating ring outer surface 118 and the knife edge inner surface 32 should have substantially the same circumference so that the shroud 80 fits within the aperture plate 18 with little or no play (movement). The self-locating ring 116 helps center the shroud 80 within the opening 30, allowing the operator to align the openings—or drill new openings in the aperture plate 18 and/or shroud 80—for receiving fasteners 50.

In still another aspect of the disclosure a method of installing a single piece cooling fan shroud 80 on an aperture plate 18 or other structure is provided. The aperture plate 18 has a free edge knife edge 32 and a plurality of spaced apart, circumferentially disposed fastener openings 48 for receiving bolts or other fasteners 50, The method comprises the steps of:

providing a cooling fan shroud 80 comprising an annular, outwardly curved body 84 having a downstream section 98 and an upstream section 100; and a mounting flange 86 affixed to the body 84 and extending radially outward therefrom, the mounting flange 86 having a free outer perimeter 108 and a inner perimeter 110 adjoining the body 84, the flange 86 defining a plurality of spaced apart circumferentially disposed flange openings 92 for receiving fasteners 50, the flange openings 92 being alignable with the aperture plate openings 48;

positioning the shroud 80 so that the flange openings 92 align with the aperture plate openings 48; and securing the shroud 80 to the aperture plate 18 with fasteners 50.

The method may include the steps of positioning the shroud 80 within the aperture plate 18, either with or without the aid of a self-locating ring 116, and drilling openings through the flange 86 and/or the aperture plate 18 for receiving the fasteners 50.

INDUSTRIAL APPLICABILITY

The multiple piece embodiment described herein is intended for use as original equipment in bulldozers and similar machines, where the cooling fan typically is located outboard of the radiator away from the engine. However, it should be understood that the multiple piece embodiment may be used in other situations, such as retrofitting a cooling system, and with any suitable cooling system, including a cooling system in which the fan is located between the radiator and the engine.

The multiple piece shroud was designed specifically for tractor machines manufactured by Caterpillar Inc. meeting U.S. Environmental Protection Agency (EPA) Tier 4 diesel emissions regulations, but could be used in other machines as well. Various shrouds can be designed for specific machines.

The single piece embodiment described herein is intended for use either as original equipment or for retrofitting in the field in heavy duty machines, including but not limited to machines in which the fan is located between the engine and the radiator.

All of the described shroud embodiments are intended to make the cooling system more efficient by improving air flow at a given fan speed by reducing fan tip clearance and increasing air flow due through the fan.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

We claim:

1. A cooling fan shroud mountable to an aperture plate having a circular knife edge defining a circular opening, the shroud comprising:

two or more functionally identical discrete sections arrangeable together to form the shroud, each section comprising an arcuate body having a convex inner surface and a concave outer surface, a partial-bell shaped downstream section and partial-bell shaped upstream section extending from either end of an arcuate duct, each of the downstream sections collectively terminating in a substantially circular downstream end, each of the upstream sections collectively terminating in a substantially circular upstream end; and a mounting flange affixed to the outer surface at the duct and extending radially outward therefrom.

2. The cooling fan shroud of claim 1 comprising four sections, wherein each section describes a ninety degree arc.

3. The cooling fan shroud of claim 1 comprising three sections, wherein each section describes a one hundred and twenty degree arc.

4. The cooling fan shroud of claim 1 comprising two sections, wherein each section describes a one hundred and eighty degree arc.

5. The cooling fan shroud of claim 1 wherein each mounting flange has a plurality of spaced apart flange openings for receiving fasteners, the flange openings being configured to cooperate with spaced apart openings in the aperture plate.

6. The cooling fan shroud of claim 5 wherein the flange openings are larger than the aperture plate openings so that the sections can be moved from one position to another with respect to the aperture plate.

7. The cooling fan shroud of claim 1 wherein the flange is discontinuous.

8. The cooling fan shroud of claim 1 wherein the sections are partially nestable.

9. A method of installing a multiple piece shroud in a cooling system, the multiple piece shroud comprising multiple discrete arcuate sections, each discrete arcuate section comprising a mounting flange, the cooling system comprising a radiator, a housing, an aperture plate mounted to the housing and having a circular knife edge defining a circular opening, a hydraulically driven cooling fan located outboard of the radiator and mounted to a bracket, the bracket having a top connected to the housing by fasteners, hydraulic hoses operably connected to the fan, and a grill located outboard the fan and bracket, the method comprising the steps of:

removing the grill;

disconnecting the hydraulic hoses from the fan;

removing the fasteners that hold the top of the bracket to the housing;

leaning the fan and the bracket outward away from the radiator to create workspace; and installing each discrete arcuate shroud section, one section at a time, by affixing each discrete arcuate shroud section to the aperture plate with fasteners.

10. The method of claim 9 comprising the further steps of:

positioning each shroud section so that its mounting flange abuts the aperture plate; and drilling axially aligned openings through each mounting flange and the aperture plate to accommodate the fasteners.

* * * * *